United States Patent [19]

David

[11] Patent Number: 4,864,775

[45] Date of Patent: Sep. 12, 1989

[54] CROSS-BELT SANDING MACHINE WITH OSCILLATING PLATEN MEANS

[75] Inventor: Eugene C. David, New Hope, Minn.

[73] Assignee: Timesavers, Inc., Minneapolis, Minn.

[21] Appl. No.: 306,085

[22] Filed: Feb. 6, 1989

Related U.S. Application Data

[63] Continuation of Ser. No. 194,106, May 16, 1988, abandoned, which is a continuation of Ser. No. 944,754, Dec. 22, 1986, abandoned, which is a continuation of Ser. No. 735,142, May 17, 1985, abandoned.

[51] Int. Cl.[4] ..... B24B 21/00

[52] U.S. Cl. ..... 51/142; 51/141

[58] Field of Search ..... 51/142, 119, 135 R, 51/138, 141, 62, 170 MT

[56] References Cited

U.S. PATENT DOCUMENTS 2,195,340 3/1940 Potash ..... 51/142

4,095,375 6/1978 Klebe et al. ..... 51/170 MT

*Primary Examiner*—Robert P. Olszewski

*Assistant Examiner*—Maurina Rachuba

*Attorney, Agent, or Firm*—Orrin M. Haugen; Thomas J. Nikolai; Frederick W. Niebuhr

[57] ABSTRACT

An endless abrasive cross-belt surface treating apparatus which includes a platen assembly arranged to move in an oscillatory or epicyclic pattern relative to the work surface. The apparatus includes means for drivably oscillating the platen as well as a pair of laterally disposed belt guiding rolls positioned immediately adjacent the platen, with such oscillatory or epicyclic motion being continuously applied to the cross-belt while workpieces are being carried or conveyed through the machine.

4 Claims, 4 Drawing Sheets

CROSS-BELT SANDING MACHINE WITH OSCILLATING PLATEN MEANS

This is a continuation of application Ser. No. 07/194,106, filed May 16, 1988, now abandoned which was a continuation of application Ser. No. 06/944,754, filed Dec. 22, 1986, now abandoned, which was a continuation of parent application Ser. No. 06/735/142, filed May 17, 1985, now abandoned.

BACKGROUND OF THE INVENTION

The present invention relates generally to an endless abrasive belt surface treating appratus, more specifically a cross-belt sanding machine having an improved platen arrangement for such an apparatus. The apparatus includes means for orbitally driving the platen along with the work-contacting portion of the abrasive cross-belt in or along an oscillatory or epicyclic path whle work is being carried or conveyed through the machine and being treated by the sanding belt. Specifically, the improved cross-belt sander of the present invention employs an oscillating platen, with the nature and contact motion between the abrasive cross-belt surface and the surface of the work being controlled by the conventional drive motion of the belt, and additionally by the oscillatory motion of the platen.

The present invention constitutes an improvement over that certain arrangement disclosed and claimed in my co-pending application Ser. No. 643,701, filed Aug. 24, 1984, entitled "Wide Belt Sanding Machine with Platen Oscillating Means", and assigned to the same assignee as the present invention, the substance of which is incorporated herein by reference. By way of contrast, the present arrangement relates to a cross-belt sanding machine rather than a wide belt sanding apparatus, while utilizing certain features of the oscillating platen system of application Ser. No. 643,701.

Belt sanders utilizing stationary platens are known in the prior art, with one such system being disclosed in U.S. Pat. No. 3,832,807, Kiser et al,, assigned to the same assignee as the present invention. Cross-belt sanders are also well known, including their basic structural framework along with their basic drum or rollr mounting means.

In a typical cross-belt sanding machine, there is provided a platen base forming a sanding head and with an endless abrasive belt trained over a plurality of rollers or drums, at least one of which is power driven, the balance of the rollers being idlers and/or guides for the belt as it moves through its orbit. The platen is normally interposed between a pair of belt guiding rollers which serve to define the belt orbit.

In the present arrangement, the belt is driven along a generally rectangular orbit or path, with the drive roller or drum preferably being disposed at one upper corner zone of the belt orbit. A sufficient amount of wrap is provided on the drive roller for it to accomplish its drive function, and with added rollers or drums being disposed closely adjacent to and on either side of the platen normally being idlers and adapted to move in an orbital path with the platen per se.

In the cross-belt sanding machine of the present invention, it has been found that the addition of the orbital platen provides for improved performance in a number of ways. For example, the utilization of this arrangement provides for improved belt life over that obtained with stationary platens, and with significantly less surface wear being observed on the belt. Additionally, improved properties are obtained in the workpieces, including improved surface qualities. Also, it has been found that it is possible to use a coarser grit on the abrasive cross-belt, with greater belt speds being possible and useful without sacrificing or reducing the surface quality of the finished product. Accordingly, belt life as well as production rates are improved without sacrificing or causing any deterioration of quality of the work product. Either a single cross-belt, or two tandemly arranged cross-belt systems may be utilized for the operation.

Typically, in the present device, work is fed into the machine by a feed system or conveyor assembly that comprises an endless horizontally oriented conveyor belt, the upper span or flight of which may cooperate with one or more pinch-rolls so as to grip the work and feed it through the machine at a uniform rate, and in a predetermined angular direction relative to the abrasive belt and its direction of travel. Alternatively, and in lieu of pinch-rolls, stationary edge guides or fences may be employed. During a typical sanding operation, of course, the top surface of the work is arranged in contact with the working surface of the abrasive cross-belt. In order to accommodate and adapt the apparatus of the present invention to workpieces having different thicknesses, the conveyor assembly is adjustable either upwardly or downwardly toward or away from the plane of the cross-belt platen, the assembly normally being supported against the force or thrust of work arranged on the conveyor belt. When two cross-belt head assemblies are arranged in tandem, it is normally desirable to provide for horizontal adjustment of at least one of the platen surfaces, relative to the other, in order to accommodate stock removal accomplished through exposure to the first cross-belt assembly.

In the utilization of a cross-belt sanding apparatus with an orbital platen, vibrational forces generated by the apparatus are generally quite low, particularly when arranged according to the present invention. This is believed to be due to the feature of the belt direction being generally transverse to the direction of motion of the work, while other factors may contribute to this reduction as well.

Belt sanding apparatus with vertically adjustable conveyors are disclosed in U.S. Pat. No. 3,832,807 referred to hereinabove, and reference is made to the disclosure in that patent for the details of the adjustable conveyor design.

SUMMARY OF THE INVENTION

The endless abrasive cross-belt workpiece surface treating apparatus of the present invention is intended to perform a sanding and/or finishing operationon a workpiece while that portion of the cross-belt in contact with the work surface is driven in an orbital or epicyclic path relative to the work. In order to generate the orbital or epicyclic path for the abrasive cross-belt, the entire platen assembly, including its laterally disposed rollers are driven along such a path. The sanding operation, when undertaken with the movavble orbiting platen and cross-belt arrangement, provides a highly desirable and uniform finish on wood surfaces, particularly wood surfaces designed for cabinetry, furniture or other similar applications.

Briefly, in accordance with the present invention, means are provided for driving the platen and a pair of laterally disposed idler rollers along an orbital or epicyclic path while the abrasive cross-belt is being carried across the platen in its normal working path. This orbital motion of the platen enhances the quality of the finish obtained on the surface of a wide variety of workpieces. In order to provide for substantially continuous operation of the apparatus, including the belt, compressed air discharge means or other known belt cleaning methods are provided to reduce and/or eliminate the build up of wood particles or dust on the working surface of the abrasive belt.

Therefore, it is a primary object of the present invention to provide an improved cross-belt sander apparatus or machine intended to perform a sanding operation, normally a finishing operation on workpieces, and wherein that portion of the orbiting belt in contact with the workpiece and the adjacent drive components of the apparatus are driven in an oscillating or orbital path in order to enhance the finishing operation.

It is a further object of the present invention to provide an improved platen-idler roll assembly for a cross-belt sanding apparatus wherein the platen along with those certain idler rolls disposed at opposed lateral edges of the platen, are driven in an oscillatory path, and accordingly move or carry that portion of the abrasive belt in contact with the workpiece along such a path.

Other and further objects of the present invention will become apparent to those skilled in the art upon a study of the following specification, appended claims, and accompanying drawings.

DESCRIPTION OF THE PREFERRED EMBODIMENT

Figure 1:
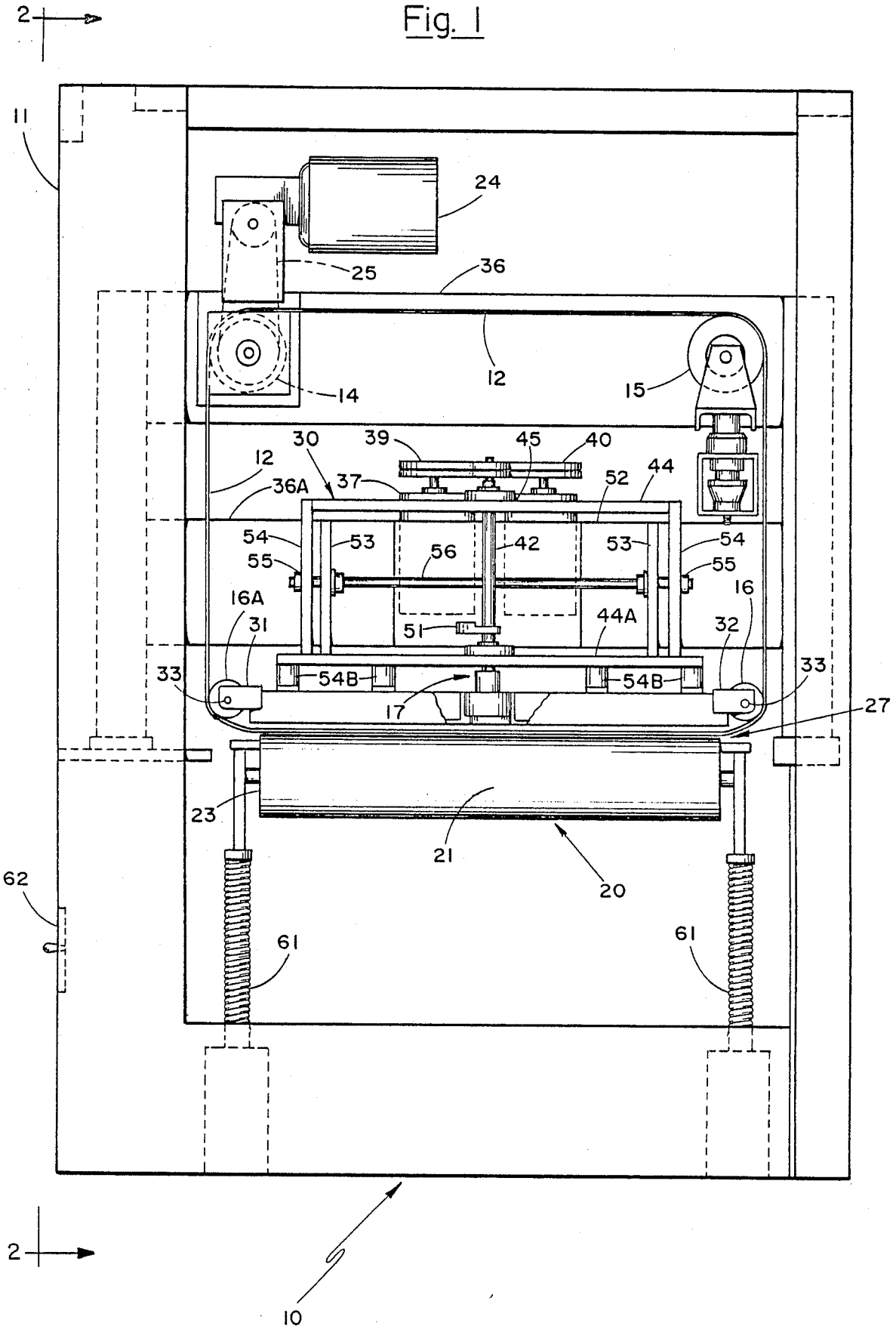
FIG. 1 is an end elevational view of a cross-belt sanding apparatus prepared in accordance with the present invention, with FIG. 1 showing the infeed end portion of the machine, and with portions of the machine being shown in phantom.
Figure 2:
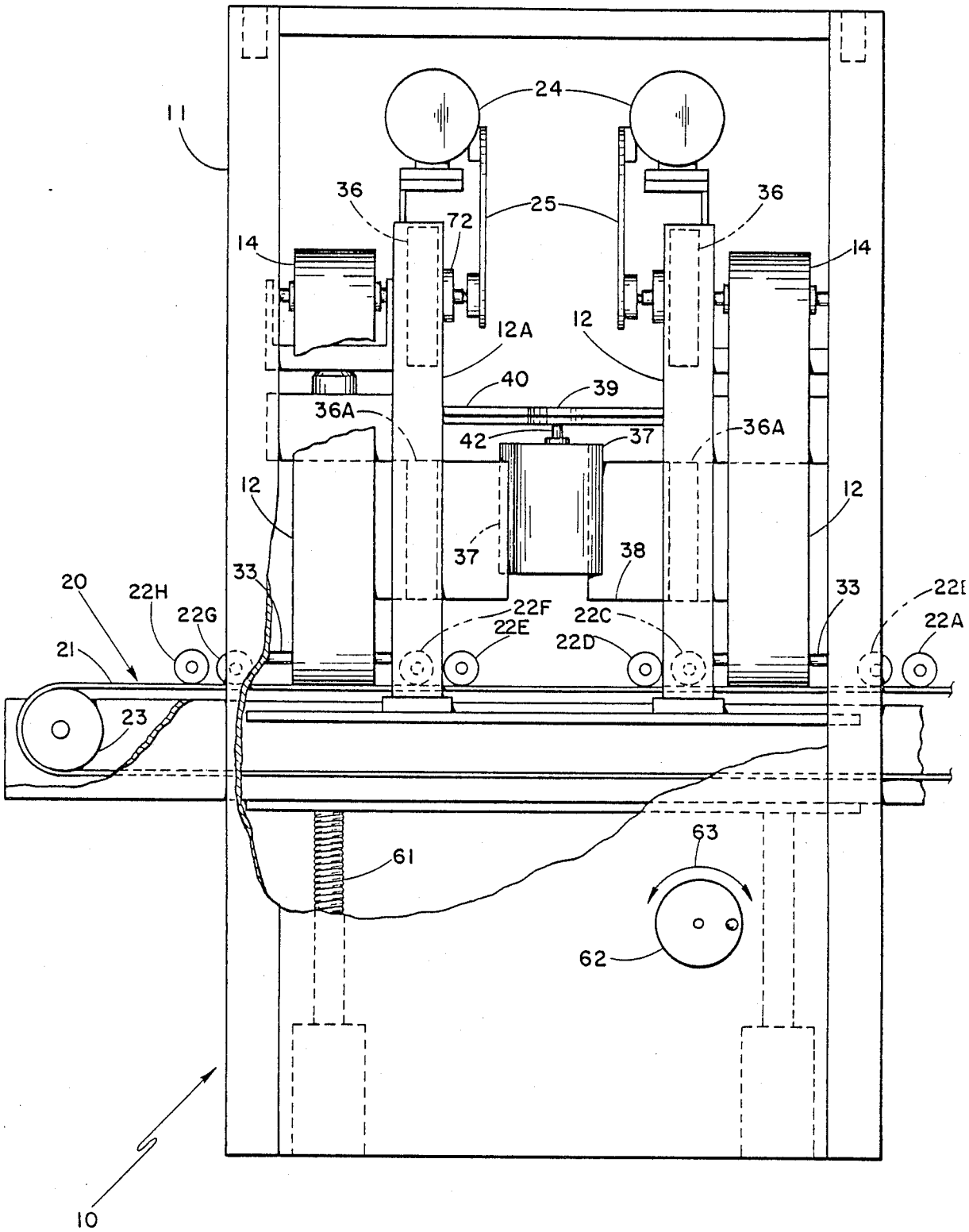
FIG. 2 is a side elevational view of the apparatus illustrated in FIG. 1, with portions of the shrouds being cut away and with portions being shown in phantom.
Figure 3:
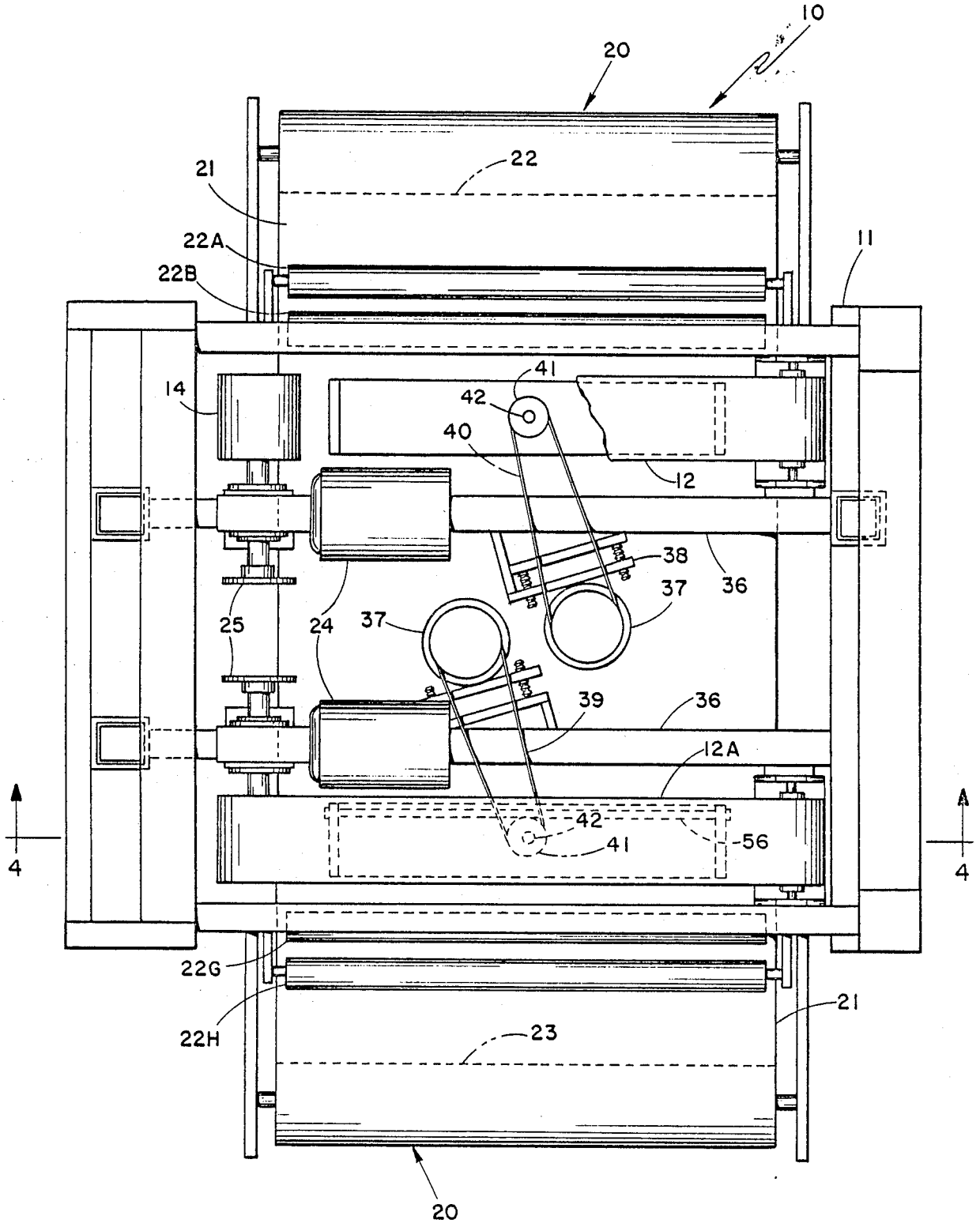
FIG. 3 is a top plan view of the belt drive and platen drive assembly of the present invention.

In accordancewith the preferred embodiment of the present invention, and with particular attention being direction to FIGS. 1, 2 and 3 of the drawings, the endless abrasive cross-belt surface treating apparatus of the present invention generally designated 10 comprises a main frame structure 11, preferably in the form of a rigid structure, such as a weldment, for supporting a work carrying conveyor and or receiving, guiding, and driving first and second endless cross-belts. As illustrated in FIG. 3, cross-belts 12 and 12A are driven about a predetermined path relative to the conveyor and are arranged to abrade the surfaces of workpieces carried along by the conveyor. In the embodiment illustrated herein, a pair of tandemly arranged cross-belts 12 and 12A are illustrated, with each cross-belt system being similar, one to the other, but with the individual belts being driven in counter-directions. It will be understood that other arrangements may be satisfactorily employed, such as, for example, an abrasive cross-belt system employing a single cross-belt which is useful for a wide variety of operations. In view of the identity of the cross-belt systems, one to the other, and for purposes of simplicity, only one such system need be described in detail. The cross-belt 12 is a typical endless abrasive belt having an outer abrasive coated working surface. Such belts are, of course, in common use and are commercially available. The belt 12 is trained about four individual properly journaled drums or rollers, such as the main drive roller 14, and the upper idler tension adjusting roller 15 and the lower oscillating idlers 16 and 16A. As is apparent from FIGS. 1 and 4 of the drawings, idler drums or rollers 16 and 16A are disposed on opposite lateral edges, such as the leading lateral edge and trailing lateral edge respectively of a platen assembly generally designated 17. In the cross-belt arrangement of the present invention, it has been found to be specifically desirable that the orbiting belt move or travel in an orbit which has a generally rectangular configuration particularly along those areas adjacent the platen assembly. In other words, at least those portions of belt path or travel lying immediately ahead of the leading contact line and those portions lying immediately behing the trailing contact line which the belt makes with idlers 16 and 16A respectively are preferably disposed normal to the plane of the platen assembly. Thus, the axes of guide rollers 14 and 16A are disposed in general vertical alignment, one to another, as are the axes of drums 15 and 16, with the platen assembly being arranged along a generally horizontal plane.

Figure 4:
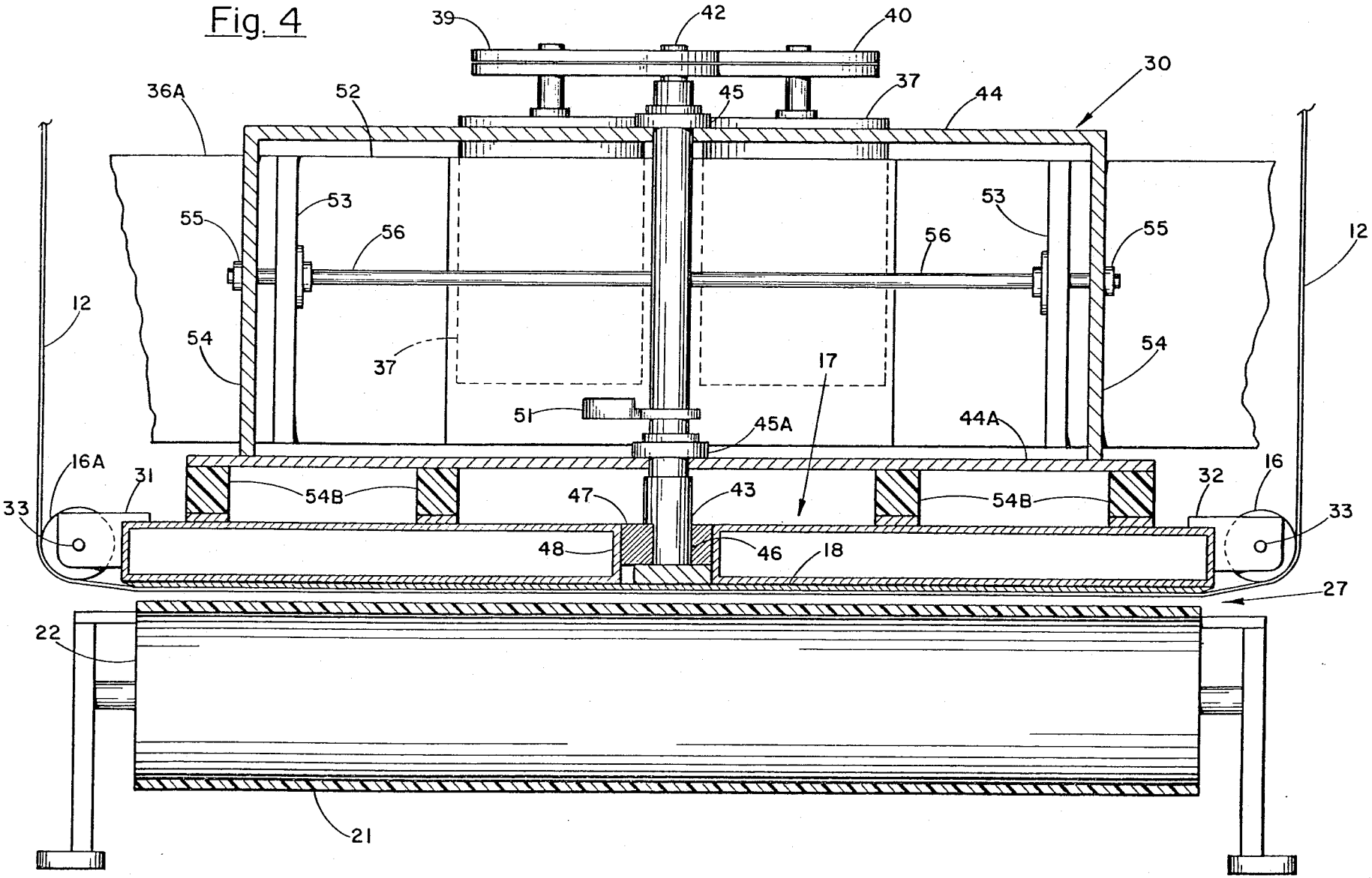
FIG. 4 is a detail sectional view of the apparatus showing the improved platen arrangement of the present invention taken along the lines and in the direction of the arrows 4—4 of FIG. 3, with FIG. 4 further showing the arrangement of the laterally disposed rollers or drums over which the abrasive cross-belt is trained, with FIG. 4 being shown on a slightly enlarged scale.

Platen assembly 17 includes a base element or pad 18 which because of limitations of draftsmanship is shown only in FIG. 4 which is arranged to provide a back-up pad and low friction inner running surface for cross-belt 12 as it moves about its predetermined orbital path, preferably providing a low coefficient of running friction with the abrasive belt. The platen pad 18 is also provides or exerts a working force for the belt to be applied against the surface of the work as it moves through the apparatus.

A conveyor means is provided to carry work through the apparatus and into contact with the abrasive cross-belt. As illustrated in FIGS. 1 and 2, the conveyor means, generally designated 20, includes a belt 21 having an upper span or flight upon which the work is carried, with the path of the belt being controlled by conveyor rolls 22 and 23, one of which is driven so as to carry the belt on its working path. As shown solely in FIG. 1, and partially in FIG. 3, multiple pinch rolls, such as illustrated at 22A, B, C, D, E, F, G, and H, are optionally arranged to cooperate with the upper flight of belt 21 to both control the forward motion of the work, as well as to function as a hold-down for the workpiece as it moves through the zone between the abrasive cross-belt 12 and conveyor belt 21. In this fashion, therefore, platen 17 along with platen pad 18 is arranged to provide a working force against the inner surface of the endless abrasive belt while the belt is trained about and moving over cross-belt path-defining drums 14, 15, 16, and 16A, and while work is moving along the conveyor 20 in contact with the belt surface.

In the endless abrasive cross-belt work surface treating apparatus 10, and particularly in the belt driving portion thereof, cylindrical drum 14 is powered by primary motor 24 and drive chain 25 so as to move the abrasive belt 12 about the individual drums or rollers while it is trained about each of the four orbit defining drums. Furthermore, the zone or area of the apparatus occupied by the platen pad 18, the portion of the abrasive cross-belt 12 moving across the platen pad 18, and upper surface of conveyor belt 21, may be collectively defined as a working station. In particular, the working staion is the zone shown generally at 27.

While worpieces are positioned within the working station 27, the upper surface of the workpiece is arranged to be in contact with and opposed to the abrasive coated outer surface of cross-belt 12. In this fashion, therefore, the surface of the workpiece is abrasively treated, and abraded and/or sanded to its desired surface finish with a surface of high quality normally being prepared. Depending upon the requirements of the operation, the nature of the workpieces, and the grit selection, the apparatus may be designed for coarse treatment of the work, including stock removal, or, alternatively, for such fine operations as sealer-coat sanding.

The main frame 11 provides a conventional support to which the belt, the cylindrical drums carrying the belt, and the orbiting platen are secured in their operative configuration. Specifically, the platen assembly 17 including lateral guide rollers or drums 16 and 16A are arranged to move in an orbital path in a horizontal plane, or in other words, in a plane which is parallel to the surface of the work being treated. The mechanism for providing orbital motion to the platen assembly is illustrated in detail in FIGS. 1, 3 and 4 of the drawings, and still further details of a somewhat modified embodiment are shown in copending application Ser. No. 643,701.

With attention being specifically directed to FIGS. 1, 3 and 4, the platen assembly 17 includes lateral side support rails 31 and 32 having journals thereinas at 33—33 for example for rotatably supporting rollers 16 and 16A therewithin. The guide rollers or drums 16 and 16A are mounted so as to be journaled for axial parallel rotation, and are, as indicated, positioned as oppositely disposed laterally leading and trailing edges of the platen 17. Furthermore and as hereinafter more fully described, orbital motion generating means are coupled to a drive system for providing the orbital motion to the platen assembly 17.

With continued attention being directed to FIG. 3, a rigid tubular upper cross-beam assembly 36 is provided, being secured to side frame members of main frame 11. Upper cross-beam 36 along with tubular lower cross-beam 36A provide means to receive a cantilevered support for portions of the abrasive cross-belt driving system, including the main drive and the drive system for providing the orbital motion to the platen. The orbital motion generating means includes drive motor 37, which is coupled through an adjustable bracket 38 to lower cross-member assembly 36A. One motor 37 drives endless belt 39, preferably a V-belt, through its motor shaft pulley, while a second belt 40 further is driven by the second motor 37, and with both belts 39 an 40 being trained about individual driven pulley members 41. Each pulley 41 is fast on its associated drive shaft 42 and, of course, is rotatable therewith. Chain drive may also be satisfactorily employed.

Shaft 42 constitutes a drive shaft for the eccentric cam 43 which is disposed at the lower end thereof. In this connection, shaft 42 is journaled within upper frame member 44 as at 45. Shaft 42 is further journaled within lower frame member 44A within a lower bearing assembly as at 45A. Rotational motion of shaft 42 provides for orbital motion of platen 17 by virtue of eccentric cam 43. In this connection, shaft 42 is provided with an eccentric portion 46 at the lower tip end thereof, with eccentric portion 46 serving as a drive for cam bearing 47. The outer race of cam bearing 47 is in operative driving contact with the inner surface of cam follower sleeve 48, which is securely mounted on the base of platen assembly 17. In this fashion, therefore, rotational motion of shaft 42 and the eccentric cam 43 imparts orbital motion to the movable portions of platen assembly 17. As shown in FIGS. 1 and 4, a number of resilient mounting pads are provided at 54B—54B in order to couple platen assembly 17 to the member 44A. In this connection, therefore, resilient mounting pads 54B—54B are in the form of rubber coupling cylinders, and permit modest controlled relative motion to occur between platen assembly 17 and the frame assembly 30.

Frame assembly 30 includes vertically arranged weldment side members 54—54, each of which are provided with cam-receiving bores as at 55—55. Inwardly of members 44, 44A and 54—54 of frame 30 are horizontal member 52 along with vertically arranged side panels 53—53. Horizontal member 52 may be a segment of tubular cross-beam 36A. Members 53—53 are secured to member 52 in order to complete a stabilized assembly movable relative to assembly 30.

With attention being directed to FIG. 1 of the drawings, cross-shaft 56 is provided, with height adjusting cams being disposed at the outer ends thereof, and within cam-following bores 55—55. The tip end, or another zone of shaft 56 is provided with flats for application of torque to the shaft. Thus, rotational motion of shaft 56 is translated into a vertical height adjustment for frame assembly 30, and ultimately platen assembly 17. As previously indicated, vertical adjustment for individual platen assemblies is normally not required, excepting in those situations where more than one cross-belt assembly is disposed in operative relationship with a single conveyor.

In order to reduce or minimize vibration, shaft 42 is provided with a counter-weight 51 which equalizes the dynamic loading imposed upon the system by the orbiting platen assembly, and counter-balances these forces. This reduces and/or eliminates vibration in the system when the system is operative.

As the work moves through the work station, wood particles removed from the surface of the work may become embedded in the surface of the abrasive belt. In order to assist in reduction of build up of accumulated dust particles, air jets may be provided, with the nozzle portions thereof being directed onto the surface of the belt either at a point adjacent its contact with the work or another convenient location. In order to reduce the discharge of dust into the ambient, a counter-rotating brush or air-lock paddle drums, which rotate counter to the direction of motion of the belt may be provided for control of the dust-ladened air particularly in the zone adjacent belt 12. Suitable dust removal hoods may be provided, with such dust removal hoods being conventional and in accordance, for example, with those disclosed in U.S. Pat. No. 3,872,627, Schuster, assigned to the same assignee as the present invention.

In order to control the work thickness dimension for accommodating work within working station 27, conveyor 20 is controllably raised and lowered by means of screws, jacks or shafts 61—61, the axial disposition of which are ultimately controlled by crank wheel 62. In other words, rotation of crank wheel 62 in the direction of the double-headed arrow 63 will raise and/or lower the plane of the upper flight of conveyor belt 21. Such an arrangement is, of course, conventional and well-known in the art. Gear boxes are provided for imparting axial motion to individual screw shafts 61—61.

In order to provide the energy needed to move abrasive cross-belt 12, main motor 24 is provided with its output shaft being, in turn, operatively coupled to drive drum 14 through chain 25 so as to impart drive motion to cross-belt 12. As is indicated in FIG. 2, drive roller or drum 14 is journaled in bearing 72, and is, in turn, coupled to upper cross-member 36 through a cantilevered support bracket or member. In order to maintainproper belt-tracking, a conventional tracking guide assembly may be utilized. One such assembly in accordance with the belt tracking assembly disclosed in U.S. Pat. No. 3,504,458, Rutt, may be used. Belt tracking may be accomplished further in accordance with the apparatus disclosed in U.S. Pat. No. 3,971,166, and assigned to the same assignee as the present invention.

In operation, therefore, cross-belt 12 is driven about its predetermined orbital path by means of power delivered from motor 24, through drive roller 14. For most applications for most conventional operations, cross-belt 12 moves at a rate of approximately 50 inches per minute, with belt speeds ranging from as low as 10 inches per minute and as high as 600 inches per minute being deemed useful. Platen assembly 17 is driven, directed and guided in an orbital path by means of power supplied from motor 37, with the orbital path having a motion radius range of approximately one-sixteenth to one-eighth inch for most applications, and moving at a rate of approximately 1,750 cycles per minute, it being understood that orbital motion for the platen in the range of from 175 up to 3,800 cycles per minute may be useful.

What is claimed is:

1. In an endlss abrasive cross-belt surface treating apparatus having substantially rigid main frame means, means for receiving, guiding and driving an endless abrasive cross-belt with an abrasive coated outer surface about a predetermined path while trained about a plurality of cylindrical drums, a platen means a resilient means, independent of said main frame means, couples said platen means with said frame assembly, to control the motion of said platen means relative to said frame assembly as said platen means moves responsive to said orbital motion generating means.

2. The endless abrasive belt surface treating apparatus as defined in claim 1 being particularly characterized in that first motor means are provided to drive one of said second pair of drums for moving said abrasive belt in its path about said first and second pairs of drums, and wherein second motor means independent of said first motor means are provided to drive said platen means in its orbital path, and wherein the outer surface of said first pair of drums is rubber.

3. The endlss abrasive cross-belt surface treating apparatus of claim 1 wherein:

said resilient means comprise a plurality of resilient pads fixedly coupled to said platen means and to said frame assembly.

4. The endless abrasive cross-belt surface treating apparatus of claim 3 wherein:

said orbital motion generating means includes a shaft mounted rotatably relative to said frame assembly, and an eccentric cam means coupled between said shaft and said platen means.

* * * * *

UNITED STATES PATENT AND TRADEMARK OFFICE

CERTIFICATE OF CORRECTION

PATENT NO. : 4,864,775

DATED : September 12, 1989

INVENTOR(S) : Eugene C. David

It is certified that error appears in the above-identified patent and that said Letters Patent is hereby corrected as shown below:

Claim 1:
Column 8, line 9, after the word "means and before --a resilient.--. Insert the attached paragraphs.

Signed and Sealed this

Third Day of December, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. :4,864,775

DATED :September 12, 1989

INVENTOR(S) :Eugene C. David

It is certified that error appears in the above-identified patent and that said Letters Patent are hereby corrected as shown below:

Column 8, Line 9, after "means", insert -- disposed generally midway between a first pair of said cylindrical drums and arranged to apply a working force against the inner surface of said endless abrasive cross-belt while said cross-belt is trained about said cylindrical drums, conveyor means for supporting workpieces with surfaces in contact with and opposed to said abrasive coated outer surface beneath said platen means, said platen means being supported for orbital motion relative to said main frame means, said platen means including rail means having journals thereon for rotatably supporting said first pair of cylindrical drums in axial parallel relationship and for positioning said platen means between the axes of said first pair of cylindrical drums, a substantially rigid frame assembly supporting said platen means, and orbital motion generating means for mounting said frame assembly movably relative to said main frame means, and for moving said platen means along an orbital path and in a plane of motion parallel to the axes of said first pair of cylindrical drums, said abrasive cross-belt surface treating apparatus being characterized in that:

said plurality of cylindrical drums includes a second pair of drums, with the axes of said second pair of drums arranged generally parallel to each other and to the axes of said first pair of drums;

each of the drums in said plurality of cylindrical drums is arranged with its peripheral surface in contact with the inner surface of said abrasive belt;

said orbital motion generating means includes a cam and cam following means for adjustably positioning said frame assembly vertically with respect to said main frame means, for adjusting the height of said platen means; and -- .